US009309481B2

(12) United States Patent
Kamano et al.

(10) Patent No.: US 9,309,481 B2
(45) Date of Patent: Apr. 12, 2016

(54) LUBRICANT COMPOSITION

(75) Inventors: Hideki Kamano, Chiba (JP); Masashi Kaji, Dusseldorf (DE)

(73) Assignee: IDEMITSU KOSAN CO., LTD., Tokyo (JP)

( * ) Notice: Subject to any disclaimer, the term of this patent is extended or adjusted under 35 U.S.C. 154(b) by 301 days.

(21) Appl. No.: 13/583,738

(22) PCT Filed: Mar. 10, 2011

(86) PCT No.: PCT/JP2011/055699
§ 371 (c)(1),
(2), (4) Date: Sep. 10, 2012

(87) PCT Pub. No.: WO2011/111795
PCT Pub. Date: Sep. 15, 2011

(65) Prior Publication Data

US 2013/0005624 A1 Jan. 3, 2013

(30) Foreign Application Priority Data

Mar. 12, 2010 (JP) ..... 2010-056646

(51) Int. Cl.
*C07D 295/02* (2006.01)
*C10M 169/04* (2006.01)
*C10M 135/04* (2006.01)
*C10M 141/08* (2006.01)

(52) U.S. Cl.
CPC ..... *C10M 141/08* (2013.01); *C10M 2203/1025* (2013.01); *C10M 2215/086* (2013.01); *C10M 2215/222* (2013.01); *C10M 2215/223* (2013.01); *C10M 2215/28* (2013.01); *C10M 2219/022* (2013.01); *C10M 2219/024* (2013.01); *C10M 2219/066* (2013.01); *C10M 2219/082* (2013.01); *C10M 2219/09* (2013.01); *C10M 2219/106* (2013.01); *C10M 2223/045* (2013.01); *C10N 2230/04* (2013.01); *C10N 2230/06* (2013.01); *C10N 2230/12* (2013.01); *C10N 2230/42* (2013.01); *C10N 2230/43* (2013.01); *C10N 2230/45* (2013.01); *C10N 2240/10* (2013.01); *C10N 2240/102* (2013.01); *C10N 2240/104* (2013.01)

(58) Field of Classification Search
CPC ..... C10M 135/22; C10M 133/38
USPC ..... 508/258, 322, 280
See application file for complete search history.

(56) References Cited

U.S. PATENT DOCUMENTS

| | | | | |
|---|---|---|---|---|
| 2,719,126 | A * | 9/1955 | Fields et al. | 508/273 |
| 5,141,658 | A | 8/1992 | DiBiase | |
| 5,693,598 | A * | 12/1997 | Abraham et al. | 508/444 |
| 6,268,316 | B1 | 7/2001 | Tanaka et al. | |
| 2005/0170978 | A1 | 8/2005 | Migdal et al. | |
| 2007/0027038 | A1 * | 2/2007 | Kamimura et al. | 508/244 |
| 2008/0300157 | A1 * | 12/2008 | Wu et al. | 508/591 |
| 2009/0203561 | A1 | 8/2009 | Kamano | |
| 2010/0009882 | A1 | 1/2010 | Ito | |
| 2010/0144567 | A1 | 6/2010 | Ito | |
| 2011/0003723 | A1 | 1/2011 | Teshima et al. | |
| 2011/0152145 | A1 * | 6/2011 | Kamano et al. | 508/255 |

FOREIGN PATENT DOCUMENTS

| | | |
|---|---|---|
| EP | 0 798 367 | 10/1997 |
| EP | 1 104 800 | 6/2001 |
| EP | 1 760 136 | 3/2007 |
| EP | 2 508 590 | 10/2012 |
| GB | 1145189 | 3/1969 |
| JP | 1 153681 | 6/1989 |
| JP | 11-279580 A | 10/1999 |
| JP | 2000 273480 | 10/2000 |
| JP | 2001 288490 | 10/2001 |
| JP | 2003-82377 A | 3/2003 |
| JP | 2004 238514 | 8/2004 |
| JP | 2004 262964 | 9/2004 |
| JP | 2004 262965 | 9/2004 |
| JP | 2007 520618 | 7/2007 |
| WO | 2008 029756 | 3/2008 |
| WO | 2008 050717 | 5/2008 |
| WO | 2008 146669 | 12/2008 |
| WO | 2009 019941 | 2/2009 |
| WO | WO 2009/101933 | 8/2009 |
| WO | 2009 113473 | 9/2009 |
| WO | 2010 087398 | 8/2010 |

OTHER PUBLICATIONS

International Search Report Issued Jun. 14, 2011 in PCT/JP11/55699 Filed Mar. 10, 2011.
Office Action issued on Feb. 3, 2015 in the corresponding Japanese Patent Application No. 2014-108912.
Supplemental European Search Report issued Jan. 7, 2016, in corresponding European Patent Application No. 11753453.7.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

A lubricant oil composition which is excellent in deposition resistance, corrosion resistance and wear resistance, despite its low phosphorus content and low sulfuric acid ash content, is provided by using a succinimide compound in combination with at least one selected from specific sulfur-containing compounds, specific heterocyclic compounds and reaction products thereof.

14 Claims, No Drawings

LUBRICANT COMPOSITION

This application is a 371 of PCT/JP2011/055699, filed Mar. 10, 2011. Priority to Japanese patent application 2010-056646, filed Mar. 12, 2010, is claimed.

TECHNICAL FIELD

The present invention relates to a lubricant oil composition and, more specifically, to a lubricant oil composition which is useful for use in internal combustion engines such as gasoline engines, diesel engines and gas engines.

BACKGROUND ART

Current automobile engines use an oxidation catalyst, a three way catalyst, an NOx occlusion reduction catalyst, a diesel particulate filter (DPF), etc. for purification of exhaust gases. These exhaust gas purification devices are known to be adversely affected by metal components, phosphorus components and sulfur components contained in the engine oil. Thus, it is known to be necessary to reduce these components in order to prevent the deterioration of these devices.

A zinc dithiophosphate (Zn-DTP) has been conventionally used over the years as a wear resisting and antioxidation agent for a lubricant oil for use in an internal combustion engine such as a gasoline engine, a diesel engine or a gas engine and is now still accepted as an important essential additive for such a lubricant oil for internal combustion engines.

The zinc dithiophosphate, which generates sulfuric acid and phosphoric acid upon being decomposed, however, may consume basic compounds contained in the engine oil and accelerate the deterioration of the lubricant oil with the result that oil change intervals are extremely short. Additionally, the zinc dithiophosphate tends to form a sludge when subjected to high temperature conditions and to cause deterioration of the property to clean the inside of an engine. Moreover, the zinc dithiophosphate which contains, in the molecule thereof, a large amount of phosphorus and sulfur components in addition to a metal (zinc) component is considered to cause an adverse influence on an exhaust gas purifying device. In this circumstance, it is desired to develop a lubricant oil composition which excels in a wear resisting property without use of the zinc dithiophosphate.

With a view toward solving these problems, various lubricant oil additives and lubricant oil compositions have been hitherto proposed. For example, Patent Documents 1 to 3 disclose lubricant oil additives and lubricant oil compositions which contain as a principle component a disulfide compound having a specific structure. Patent Document 4 discloses a triazine compound as a lubricant additive. Further, Patent Document 5 discloses a lubricant oil which contains a thiadiazol compound.

PRIOR ART DOCUMENT

Patent Document

Patent Document 1: JP-2004-262964A
Patent Document 2: JP-2004-262965A
Patent Document 3: JP-2008-056876A
Patent Document 4: JP-H01-153681A
Patent Document 5: JP-2004-238514A

SUMMARY OF THE INVENTION

Problems to be Solved by the Invention

Although development of various lubricant oil additives and lubricant oil compositions has been thus far been made as described above, the lubricant oil compositions disclosed in the above documents are not fully satisfactory when taking into consideration that lubricant oils are generally required to satisfy various performances, such as performance against catalytic poisoning, wear resistance and friction reducing effect, at the same time. In particular, it has been difficult to provide a lubricant oil composition, which exhibits performances comparable to or better than those of the conventional ones, without using zinc dithiophosphate which is a very effective additive for improving wear resistance and oxidation resistance.

The present invention has been made in view of the foregoing circumstances and is aimed at the provision of a lubricant oil composition which is excellent in deposition resistance, corrosion resistance and wear resistance, despite its low phosphorus content and low sulfuric acid ash content.

Means for Solving the Problem

The present inventors have made an earnest study and found that the above-described object can be achieved by using a succinimide compound in combination with at least one selected from specific sulfur-containing compounds, specific heterocyclic compounds and reaction products thereof. The present invention has been completed based on such a finding.

Namely, the present invention provides:

<1> A lubricant oil composition comprising a base oil, a succinimide compound, and at least one selected from the following components (A) to (C):

(A) a sulfur-containing compound represented by the general formula (I) shown below,

[Formula 1]

$$R^1—Y—(CH_2)_n—S_{x1}—(CH_2)_n—Y—R^2 \quad (I)$$

wherein $R^1$ and $R^2$ each independently represent a hydrogen atom; a $C_1$-$C_{50}$ hydrocarbon group selected from alkyl groups, cycloalkyl groups, alkenyl groups, cycloalkenyl groups and aryl groups; or a $C_1$-$C_{50}$ hetero atom-containing group having an atom which is selected from an oxygen atom, a nitrogen atom and a sulfur atom and which is contained in the above hydrocarbon group;

Ys each independently represent a divalent group selected from —O—, —S—, —SO—, —$SO_2$—, —(C═O)O—, —(C═O)NH—, —O(C═O)NH—, —C(═O)—, —N(H)—, —NHCONH—, —N═N—, —NH—C(═NH)—NH—, —S—C(═O)—, —NH—C(═S)— and —NH—C(═S)—NH—;

X1 represents an integer of 1 to 3; and ns each independently represent an integer of 1 to 5, (B) a sulfur-containing compound represented by the general formula (II) shown below,

[Formula 2]

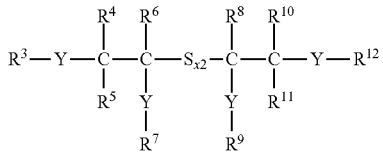

(II)

wherein $R^3$ to $R^{12}$ each independently represent a hydrogen atom; a $C_1$-$C_{50}$ hydrocarbon group selected from alkyl groups, cycloalkyl groups, alkenyl groups, cycloalkenyl groups and aryl groups; or a $C_1$-$C_{50}$ hetero atom-containing group having an atom which is selected from an oxygen atom, a nitrogen atom and a sulfur atom and which is contained in the above hydrocarbon group, Ys each independently represent a divalent group selected from —O—, —S—, —SO—, —$SO_2$—, —(C═O)O—, —(C═O)NH—, —O(C═O)NH—, —C(═O)—, —N(H)—, —NHCONH—, —N═N—, —NH—C(═NH)—NH—, —S—C(═O)—NH—C(═S)— and —NH—C(═S)—NH—, and X2 represents an integer of 1 to 3, (C) a heterocyclic compound, which is represented by the general formula (III) shown below and which may have a double bond or bonds in a cyclic moiety thereof, or a reaction product of the heterocyclic compound with a compound selected from a boron compound, a molybdenum compound and a silicon compound,

[Formula 3]

(III)

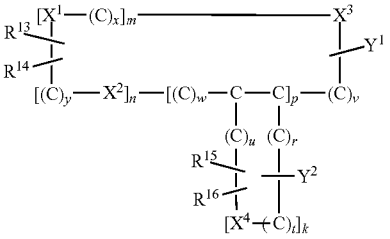

wherein $X^1$, $X^2$, $X^3$ and $X^4$ each independently represent N, NH, O or S, p is 0 or 1, x and y each independently represent an integer of 0 to 2, u and r each independently represent an integer of 0 to 3, t and w each independently represent an integer of 0 to 3, v represents an integer of 0 to 5 when p is 0 or represents an integer of 0 to 3 when p is 1, n and m each independently represent an integer of 0 or 1, k is an integer of 0 to 3, with the proviso that x, y, n, m and v are not 0 at the same time when p is 0, $R^{13}$ to $R^{16}$ each independently represent a hydrogen atom bonded to a carbon atom; a $C_1$-$C_{50}$ hydrocarbon group; a $C_1$-$C_{50}$ functional group selected from an amino group, an amide group, an ether group, a thioether group, a dithioether group and a carboxyl group; or a hydrocarbon group which has 1 to 150 carbon atoms in total and which has at least one substituent group selected from the functional groups, with the proviso that $R^{13}$ and $R^{14}$ do not represent a hydrogen atom at the same time when p is 0 and that $R^{13}$ to $R^{16}$ do not represent a hydrogen atom at the same time when p is 1, and $Y^1$ and $Y^2$ each independently represent a hydrogen atom; a halogen atom; a $C_1$-$C_{50}$ functional group selected from an amino group, an amide group, a hydroxyl group, a carbonyl group, an aldehyde group, a carboxyl group, an ester group and an ether group; or a hydrocarbon group or a heterocyclic group each of which has 1 to 150 carbon atoms in total and may have at least one group selected from the functional groups.

<2> The lubricant oil composition according to above <1>, wherein the lubricant oil composition has a phosphorus content of 0.5% by mass or less and a sulfuric acid ash content of 0.6% by mass or less.

<3> The lubricant oil composition according to above <1> or <2>, wherein the lubricant oil composition has a phosphorus content of 0% by mass and a sulfuric acid ash content of 0.1% by mass or less.

<4> The lubricant oil composition according to any one of above <1> to <3>, wherein X1 in the above general formula (I) is 1.

<5> The lubricant oil composition according to any one of above <1> to <4>, wherein the lubricant oil composition is used in an engine equipped with a post treatment device.

Effect of the Invention

According to the present invention, there is provided a lubricant oil composition which is excellent in deposition resistance, corrosion resistance and wear resistance, despite its low phosphorus content and a low sulfuric acid ash content.

EMBODIMENTS OF THE INVENTION

The lubricant oil composition of the present invention is characterized in that a base oil is compounded with a succinimide compound and at least one selected from components (A) to (C) shown below.

Base Oil:

The base oil used in the present invention is not specifically limited and may be appropriately selected from any mineral oils and synthetic oils that are conventionally used as a base oil for lubricant oils.

Examples of the mineral oils include those which are obtained by subjecting a lube-oil distillate (which is obtained by vacuum distillation of an atmospheric residue produced by atmospheric distillation of a crude oil) to one or more refining treatments such as solvent deasphalting, solvent extraction, hydrocracking, solvent dewaxing, catalytic dewaxing and hydrorefining, and those which are produced by isomerizing waxes or GTL waxes.

Examples of the synthetic oils include polybutene, polyolefins (α-olefin homopolymers and copolymers (such as ethylene-α-olefin copolymers)), various esters (such as polyol esters, dibasic acid esters and phosphoric acid esters), various ethers (such as polyphenyl ethers), polyglycols, alkyl benzenes and alkyl naphthalenes. Among these synthetic oils, particularly preferred are polyolefins and polyol esters.

In the present invention, the above mineral oils may be used alone or in combination of two or more thereof as the base oil. Also, the above synthetic oils may be used alone or in combination of two or more thereof. Further, one or more mineral oils may be used in combination with one or more synthetic oils.

The viscosity of the base oil is not specifically limited. However, it is preferred that the base oil have a kinematic viscosity at 100° C. of 2 to 30 $mm^2/s$, more preferably 3 to 15 $mm^2/s$, still more preferably 4 to 10 $mm^2/s$.

When the kinematic viscosity at 100° C. is 2 $mm^2/s$ or more, an evaporation loss is small. When the kinematic viscosity is 30 $mm^2/s$ or less, a power loss by viscosity resistance can be suppressed so that a fuel consumption improving effect is obtainable.

It is also preferred that the base oil have a % $C_A$ value of 3.0 or less as measured by ring analysis and a sulfur content of 50 ppm by mass or less. As used herein, the term "% $C_A$ value as measured by ring analysis" means a proportion (percentage) of an aromatic component which is calculated by the n-d-M ring analysis method. The sulfur content as used herein means the value as measured according to JIS K 2541.

The base oil having a % $C_A$ value of 3.0 or less and a sulfur content of 50 ppm by mass or less exhibits good oxidation stability and can give a lubricant oil composition that can suppress an increase of the acid value and formation of a sludge. The % $C_A$ value is more preferably 1.0 or less, still more preferably 0.5 or less. The sulfur content is more preferably 30 ppm by mass or less.

It is further preferred that the base oil have a viscosity index of 70 or more, more preferably 100 or more, still more preferably 120 or more. When the viscosity index of the base oil is 70 or more, a change in viscosity of the base oil by a change in temperature is small.

Succinimide Compound:

As the succinimide compound used in the present invention there may be mentioned a mono-type succinimide compound represented by the following general formula (IV) or a bis-type succinimide compound represented by the following general formula (V):

[Formula 4]

(IV)

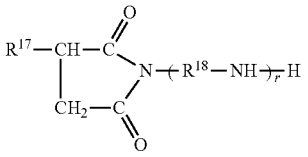

(V)

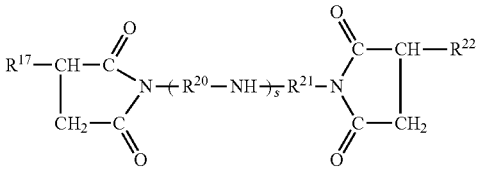

In the above general formulas (IV) and (V), $R^{17}$, $R^{19}$ and $R^{22}$ each represent an alkenyl group or an alkyl group having a number-average molecular weight of 500 to 4,000. The groups and $R^{19}$ and $R^{22}$ may be the same or different. The number-average molecular weight of $R^{17}$, $R^{19}$ and $R^{22}$ is preferably from 1,000 to 4,000. When the number-average molecular weight of $R^{17}$, $R^{19}$ and $R^{22}$ is 500 or more, the solubility of the compound in the base oil is good. When the number-average molecular weight is 4,000 or less, there is no fear of deterioration of the dispersibility.

In the formulas, $R^{18}$, $R^{20}$ and $R^{21}$ each represent a $C_2$ to $C_5$ alkylene group. The groups $R^{20}$ and $R^{21}$ may be the same or different. The symbol r is an integer of 1 to 10, and s is 0 or an integer of 1 to 10. The symbol r is preferably 2 to 5, more preferably 3 or 4. When r is 1 or more, good dispersibility may be obtained. When r is 10 or less, the compound exhibits good solubility in the base oil.

Further, in the general formula (V), s is preferably 1 to 4, more preferably 2 or 3. The symbol s that lies within the above-specified range is preferred for reasons of the dispersibility and solubility in the base oil.

Examples of the alkenyl group include a polybutenyl group, a polyisobutenyl group and an ethylene-propylene copolymer group. Examples of the alkyl group include those which are obtainable by hydrogenating these alkenyl groups. Typical examples of the suitable alkenyl group include a polybutenyl group and a polyisobutenyl group. The polybutenyl group may be obtained by polymerizing a mixture of 1-butene and isobutene, or high-purity isobutene. Typical examples of the suitable alkyl group include those which are obtainable by hydrogenating a polybutenyl group or a polyisobutenyl group.

As the succinimide compound, an alkenyl succinimide compound such as a polybutenyl succinimide or an alkyl succinimide compound is preferably used.

The above alkenyl succinimide compound or alkyl succinimide compound may be generally produced by reacting an alkenyl succinic anhydride, obtained by reaction of a polyolefin with maleic anhydride, or an alkyl succinic anhydride, obtained by hydrogenating the alkenyl succinic anhydride, with a polyamine. Also, the above mono-type succinimide compound or bis-type succinimide compound may be produced by varying a proportion between the alkenyl succinic anhydride or alkyl succinic anhydride and the polyamine to be reacted.

As an olefin monomer constituting the above polyolefin, there may be used a $C_2$ to $C_8$ α-olefin or a mixture of two or more thereof. Among them, a mixture of isobutene and butene-1 may be suitably used.

Examples of the polyamine include primary diamines such as ethylenediamine, propylenediamine, butylenediamine and pentylenediamine; polyalkylene polyamines such as diethylenetriamine, triethylenetetramine, tetraethylenepentamine, pentaethylenehexamine, di(methylethylene)triamine, dibutylenetriamine, tributylenetetramine and pentapentylenehexamine; and piperazine derivatives such as aminoethyl piperazine.

In addition to the above alkenyl or alkyl succinimide compound, there may also be used boron derivatives thereof and/or organic acid-modified products of those derivatives as the succinimide compound.

The boron derivatives of the alkenyl or alkyl succinimide compound used in the present invention may be produced by an ordinary method. For example, the boron derivatives may be produced by first reacting the above polyolefin with maleic anhydride to obtain an alkenyl succinic anhydride, and then reacting the resulting alkenyl succinic anhydride with an intermediate product obtained by reacting the above polyamine with a boron compound such as boron oxide, a boron halide, boric anhydride, a boric acid ester or an ammonium salt of orthoboric acid to imidize the alkenyl succinic anhydride.

The content of boron in the boron derivatives is not particularly limited, but is preferably in the range of 0.05 to 5% by mass, more preferably 0.1 to 3% by mass, in terms of boron element.

The compounding amount of the succinimide compound is preferably 0.5 to 15% by mass, more preferably 1 to 10% by mass, still more preferably 3 to 7% by mass, based on a total amount of the lubricant oil composition.

When the compounding amount is 0.5% by mass or more, the deposition resistance of the lubricant oil composition is sufficiently improved. When the compounding amount is 15% by mass or less, the fluidity at low temperatures of the lubricant oil composition is greatly improved.

Sulfur-Containing Compound:

The above-mentioned component (A) is a sulfur-containing compound represented by the general formula (I) shown below and the component (B) is a sulfur compound represented by the general formula (II) shown below.

[Formula 5]

$$R^1—Y—(CH_2)_n—S_{x1}—(CH_2)_n—Y—R^2 \quad (I)$$

(in the above formula, $R^1$ and $R^2$ each independently represent a hydrogen atom; a $C_1$-$C_{50}$ hydrocarbon group selected from alkyl groups, cycloalkyl groups, alkenyl groups, cycloalkenyl groups and aryl groups; or a $C_1$-$C_{50}$ hetero atom-containing group having an atom which is selected from an oxygen atom, a nitrogen atom and a sulfur atom and which is contained in the above hydrocarbon group; Ys each independently represent a divalent group selected from —O—, —S—, —SO—, —$SO_2$—, —(C═O)O—, —(C═O)NH—, —O(C═O)NH—, —C(═O)—N(H)—NHCONH—, —NH—C(═NH)—NH—, —S—C(═O)—, —NH—C(═S)— and —NH—C(═S)—NH—; X1 represents an integer of 1 to 3; and ns each independently represent an integer of 1 to 5).

[Formula 6]

(II)

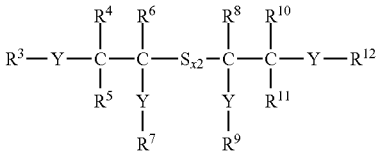

(in the above formula, $R^3$ to $R^{12}$ each independently represent a hydrogen atom; a $C_1$-$C_{50}$ hydrocarbon group selected from alkyl groups, cycloalkyl groups, alkenyl groups, cycloalkenyl groups and aryl groups; or a $C_1$-$C_{50}$ hetero atom-containing group having an atom which is selected from an oxygen atom, a nitrogen atom and a sulfur atom and which is contained in the above hydrocarbon group; Ys each independently represent a divalent group selected from —O—, —S—, —SO—, —$SO_2$—, —(C═O)O—, —(C═O)NH—, —O(C═O)NH—, —C(═O)—N(H)—NHCONH—, —N═N—, —NH—C(═NH)—NH—, —S—C(═O)—NH—C(═S)— and —NH—C(═S)—NH—; and X2 represents an integer of 1 to 3).

In the above formulas (I) and (II), the alkyl group represented by $R^1$ to $R^{12}$ is preferably a $C_1$ to $C_{30}$ alkyl group, more preferably a $C_1$ to $C_{24}$ alkyl group. Specific examples of the alkyl group include an n-butyl group, an isobutyl group, a sec-butyl group, a tert-butyl group, various hexyl groups, various octyl groups, various decyl groups, various dodecyl groups, various tetradecyl groups, various hexadecyl groups, various octadecyl groups and various icosyl groups. The alkyl group may be substituted with an aromatic group, examples of which include a benzyl group and a phenethyl group.

The cycloalkyl group represented by $R^1$ to $R^{12}$ is preferably a $C_3$ to $C_{30}$ cycloalkyl group, more preferably a $C_3$ to $C_{24}$ cycloalkyl group. Specific examples of the cycloalkyl group include a cyclopropyl group, a cyclopentyl group, a cyclohexyl group, a methylcyclopentyl group, a dimethylcyclopentyl group, a methylethylcyclopentyl group, a diethylcyclopentyl group, a methylcyclohexyl group, a dimethylcyclohexyl group, a methylethylcyclohexyl group and a diethylcyclohexyl group. The cycloalkyl group may be substituted with an aromatic group, examples of which include a phenylcyclopentyl group and a phenylcyclohexyl group.

The alkenyl group represented by $R^1$ to $R^{12}$ is preferably a $C_2$ to $C_{30}$ alkenyl group, more preferably a $C_2$ to $C_{24}$ alkenyl group. Specific examples of the alkenyl group include a vinyl group, an allyl group, a 1-butenyl group, a 2-butenyl group, a 3-butenyl group, 1-methylvinyl group, a 1-methylallyl group, a 1,1-dimethylallyl group, a 2-methylallyl group, a nonenyl group, a decenyl group and an octadecenyl group. The alkenyl group may be substituted with an aromatic group.

The cycloalkenyl group represented by $R^1$ to $R^{12}$ is preferably a $C_3$ to $C_{30}$ cycloalkenyl group, more preferably a $C_3$ to $C_{24}$ cycloalkenyl group. Specific examples of the cycloalkenyl group include a cyclobutenyl group and a methylcyclobutenyl group. The cycloalkenyl group may be substituted with an aromatic group.

The aryl group represented by $R^1$ to $R^{12}$ is preferably a $C_6$ to $C_{30}$ aryl group, more preferably a $C_6$ to $C_{24}$ aryl group. Specific examples of the aryl group include a phenyl group, a tolyl group, a xylyl group, a naphthyl group, a butylphenyl group, an octylphenyl group and a nonylphenyl group.

In the general formulas (I) and (II), Ys each independently represent a divalent group selected from —O—, —S—, —SO—, —$SO_2$—, —(C═O)O—, —(C═O)NH—, —O(C═O)NH—, —C(═O)—N(H)—NHCONH—, —N═N—, —NH—C(═NH)—NH—, —S—C(═O)—NH—C(═S)— and —NH—C(═S)—NH—.

In the general formulas (I) and (II), X1 and X2 are each an integer of 1 to 3, preferably 1, and ns each independently represent an integer of 1 to 5, preferably 1 or 2.

As the sulfur-containing compound represented by the general formula (I), there may be mentioned, for example, compounds of the formulas shown below, wherein x is an integer of 1 to 3.

[Formula 7]

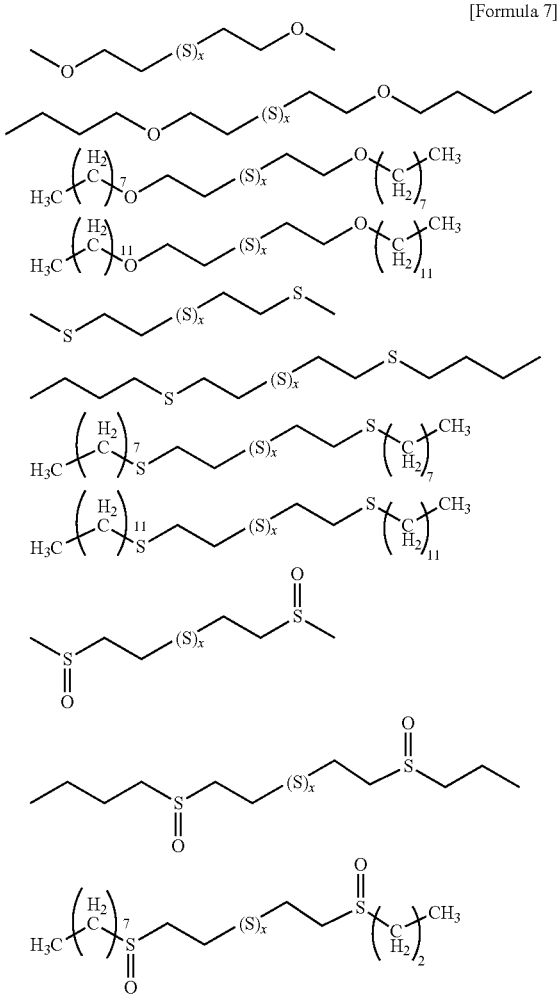

-continued
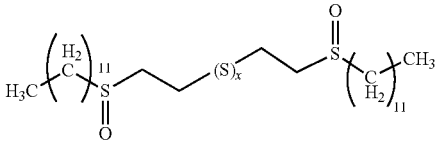
[Formula 8]
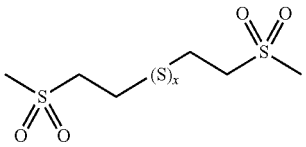
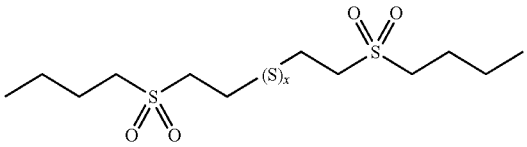
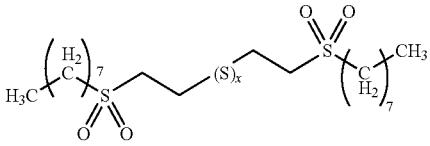
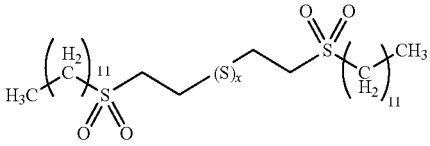
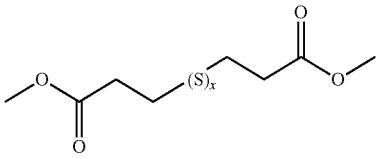
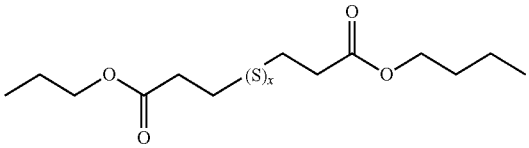
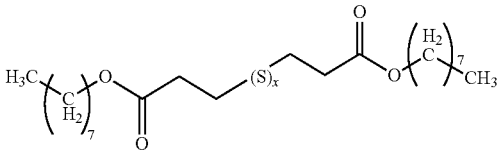
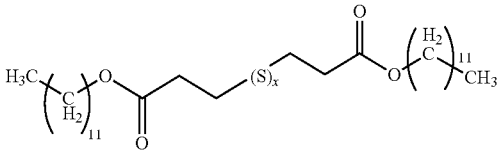
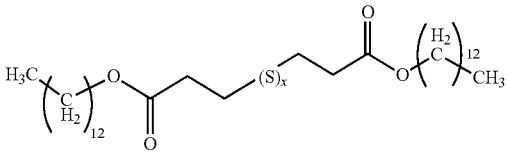
[Formula 9]
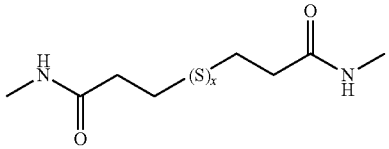
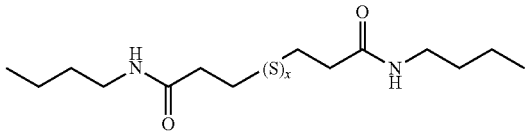
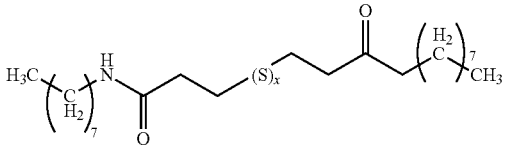
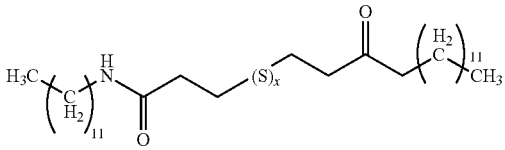
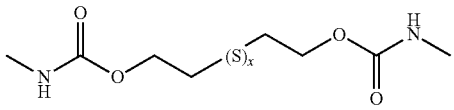
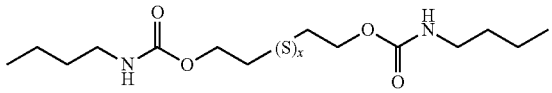
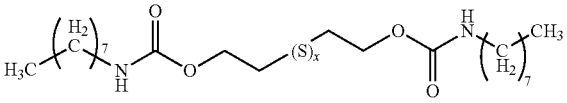
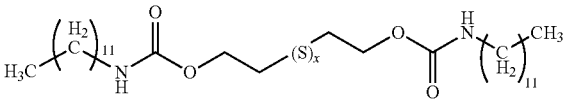
[Formula 10]
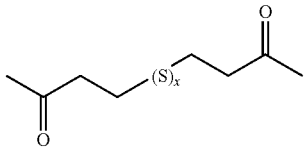
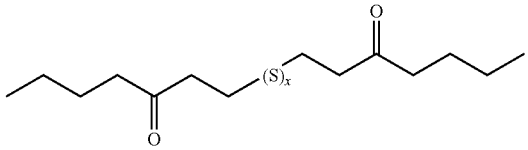
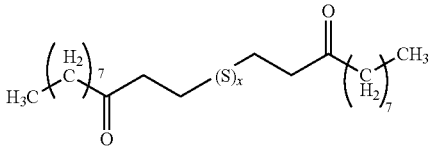
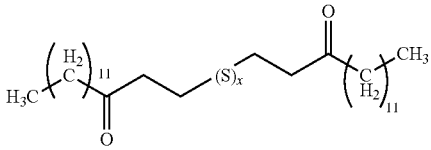

-continued
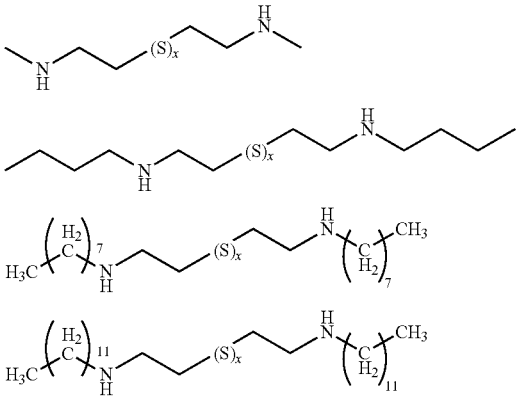
[Formula 11]
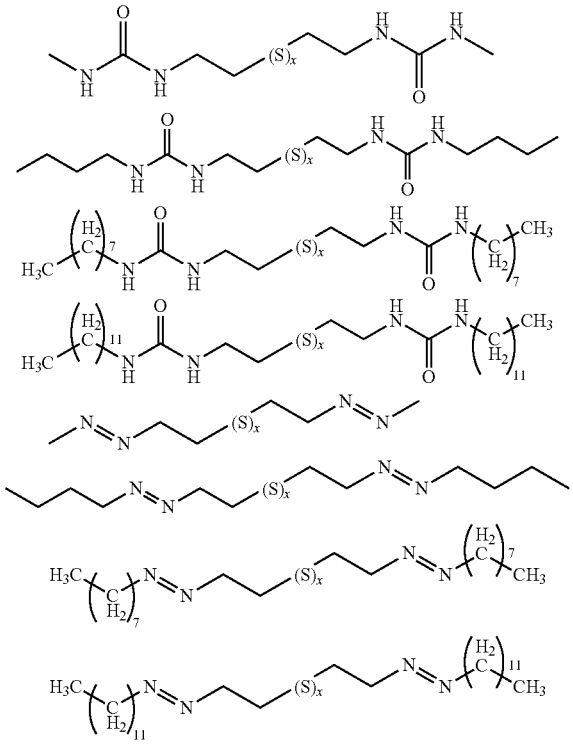
[Formula 12]
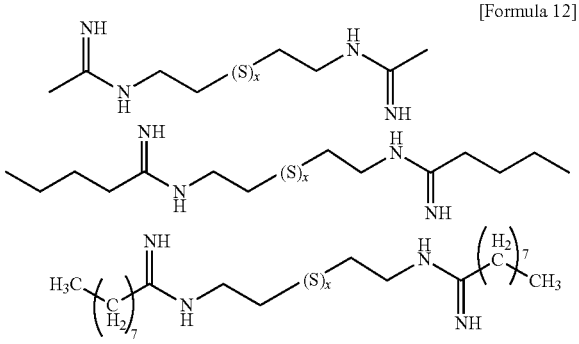
-continued
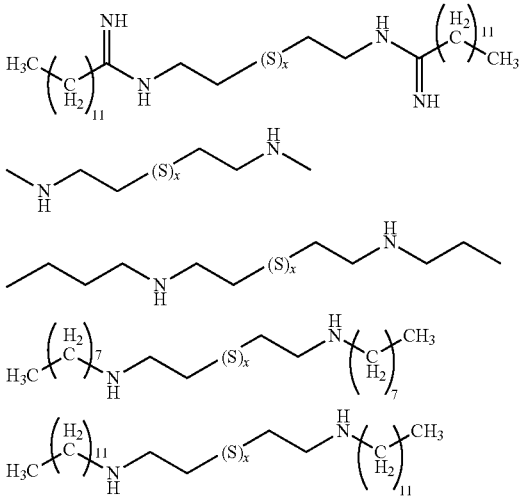
[Formula 13]
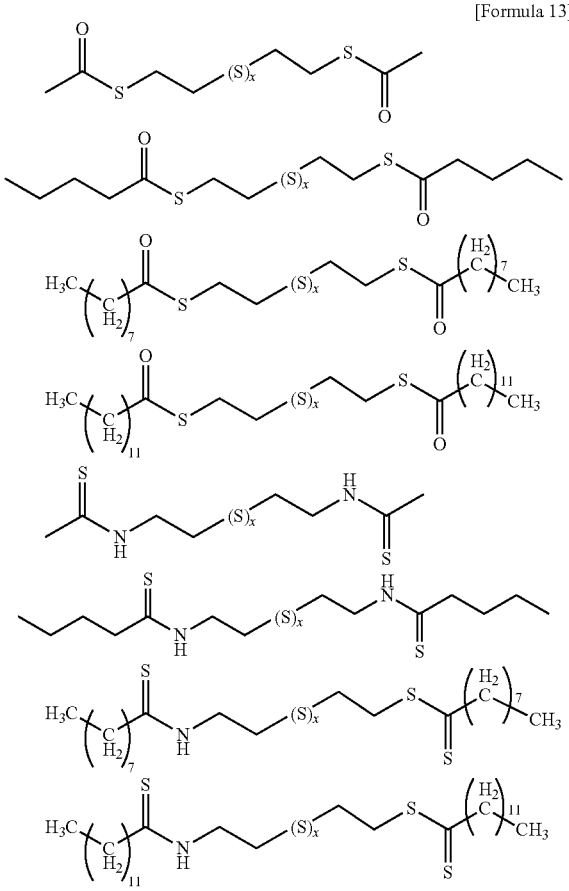
[Formula 14]
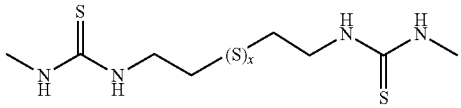

-continued

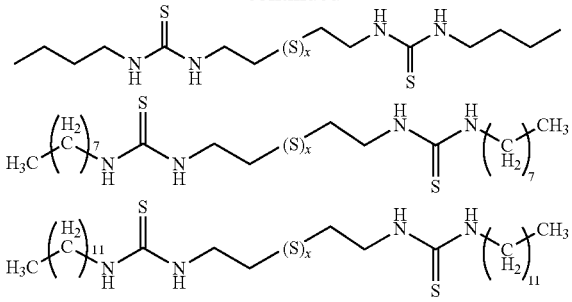

The following compounds are also examples of the sulfur-containing compound represented by the general formula (I), i.e. such examples include: disulfides such as bis(methoxycarbonylmethyl)disulfide, bis(ethoxycarbonylmethyl)disulfide, bis(n-propoxycarbonylmethyl)disulfide, bis(isopropoxycarbonylmethyl)disulfide, bis(n-butoxycarbonylmethyl)disulfide, bis(n-octoxycarbonylmethyl)disulfide, bis(n-dodecyloxycarbonylmethyl)disulfide, bis(cyclopropoxycarbonylmethyl)disulfide, 1,1-bis(2-methoxycarbonylethyl)disulfide, 1,1-bis(3-methoxycarbonyl-n-propyl)disulfide, 1,1-bis(4-methoxycarbonyl-n-butyl)disulfide, 1,1-bis(2-ethoxycarbonylethyl)disulfide, 1,1-bis(2-n-propoxycarbonylethyl)disulfide, 1,1-bis(2-isopropoxycarbonylethyl)disulfide, 1,1-bis(2-cyclopropoxycarbonylethyl)disulfide and bis(tridecyl oxycarbonylethyl)disulfide; and monosulfides such as bis(methoxycarbonylmethyl)sulfide, bis(ethoxycarbonylmethyl)sulfide, bis(n-propoxycarbonylmethyl)sulfide, bis(isopropoxycarbonylmethyl)sulfide, bis(n-butoxycarbonylmethyl)sulfide, bis(n-octoxycarbonylmethyl)sulfide, bis(n-dodecyloxycarbonylmethyl)sulfide, bis(cyclopropoxycarbonylmethyl)sulfide, 1,1-bis(2-methoxycarbonylethyl)sulfide, 1,1-bis(3-methoxycarbonyl-n-propyl)sulfide, 1,1-bis(4-methoxycarbonyl-n-butyl)sulfide, 1,1-bis(2-ethoxycarbonylethyl)sulfide, 1,1-bis(2-n-propoxycarbonylethyl)sulfide, 1,1-bis(2-isopropoxycarbonylethyl)sulfide, 1,1-bis(2-cyclopropoxycarbonylethyl)sulfide and bis(tridecyloxycarbonylethyl)sulfide.

Specific examples of the sulfur-containing compound represented by the general formula (II) include: disulfides such as tetramethyl dithiomalate, tetraethyl dithiomalate, tetra-1-propyl dithiomalate, tetra-2-propyl dithiomalate, tetra-1-butyl dithiomalate, tetra-2-butyl dithiomalate, tetraisobutyl dithiomalate, tetra-1-hexyl dithiomalate, tetra-1-octyl dithiomalate, tetra-1-(2-ethyl)hexyl dithiomalate, tetra-1-(3,5,5-trimethyl)hexyl dithiomalate, tetra-1-decyl dithiomalate, tetra-1-dodecyl dithiomalate, tetra-1-hexadecyl dithiomalate, tetra-1-octadecyl dithiomalate, tetrabenzyl dithiomalate, tetra-α-(methyl)benzyl dithiomalate, tetra-α,α-dimethylbenzyl dithiomalate, tetra-1-(2-methoxy)ethyl dithiomalate, tetra-1-(2-ethoxy)ethyl dithiomalate, tetra-1-(2-butoxy)ethyl dithiomalate, tetra-1-(2-ethoxy)ethyl dithiomalate, tetra-1-(2-butoxybutoxy)ethyl dithiomalate and tetra-1-(2-phenoxy)ethyl dithiomalate; and monosulfides such as tetramethyl thiomalate, tetraethyl thiomalate, tetra-1-propyl thiomalate, tetra-2-propyl thiomalate, tetra-1-butyl thiomalate, tetra-2-butyl thiomalate, tetraisobutyl thiomalate, tetra-1-hexyl thiomalate, tetra-1-octyl thiomalate, tetra-1-(2-ethyl)hexyl thiomalate, tetra-1-(3,5,5-trimethyl)hexylthiomalate, tetra-1-decyl thiomalate, tetra-1-dodecyl thiomalate, tetra-1-hexadecyl thiomalate, tetra-1-octadecyl thiomalate, tetrabenzyl thiomalate, tetra-α-(methyl)benzyl thiomalate, tetra-α,α-dimethylbenzyl thiomalate, tetra-1-(2-methoxy)ethyl thiomalate, tetra-1-(2-ethoxy)ethyl thiomalate, tetra-1-(2-butoxy)ethyl thiomalate, tetra-1-(2-ethoxy)ethyl thiomalate, tetra-1-(2-butoxybutoxy)ethyl thiomalate and tetra-1-(2-phenoxy)ethyl thiomalate.

Heterocyclic Compound or Reaction Product Thereof:

The above-mentioned component (C) is a heterocyclic compound, which is represented by the general formula (III) shown below and which may have a double bond or bonds in a cyclic moiety thereof, or a reaction product of the heterocyclic compound with a compound selected from a boron compound, a molybdenum compound and a silicon compound.

[Formula 15]

(III)

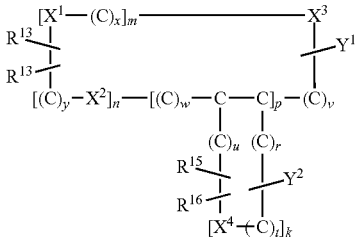

(In the general formula (III), $X^1$, $X^2$, $X^3$ and $X^4$ each independently represent N, NH, O or S, and p is 0 or 1. The symbols x and y each independently represent an integer of 0 to 2, u and r each independently represent an integer of 0 to 3, and t and w each independently represent an integer of 0 to 3. When p is 0, v represents an integer of 0 to 5, and when p is 1, v represents an integer of 0 to 3. The symbols n and m each independently represent an integer of 0 or 1, and k is an integer of 0 to 3. When p is 0, x, y, n, m and v are not 0 at the same time. $R^{13}$ to $R^{16}$ each independently represent a hydrogen atom bonded to a carbon atom; a $C_1$-$C_{50}$ hydrocarbon group; a $C_1$-$C_{50}$ functional group selected from an amino group, an amide group, an ether group, a thioether group, a dithioether group and a carboxyl group; or a hydrocarbon group which has 1 to 150 carbon atoms in total and which has at least one substituent group selected from the functional groups. When p is 0, $R^{13}$ and $R^{14}$ do not represent a hydrogen atom at the same time, when p is 1, $R^{13}$ to $R^{16}$ do not represent a hydrogen atom at the same time. $Y^1$ and $Y^2$ each independently represent a hydrogen atom; a halogen atom; a $C_1$-$C_{50}$ functional group selected from an amino group, an amide group, a hydroxyl group, a carbonyl group, an aldehyde group, a carboxyl group, an ester group and an ether group; or a hydrocarbon group or a heterocyclic group each of which has 1 to 150 carbon atoms in total and may have at least one group selected from the functional groups.)

In the above general formula (III), (1) when p is 0, $X^1$, $X^2$ and $X^3$ each independently represent N, NH, O or S, x and y each independently represent an integer of 0 to 2 and v is an integer of 0 to 5, n and m each independently represent 0 or 1 and x, y, n, m and v do not represent 0 at the same time, and $R^{13}$ and $R^{14}$ each independently represent a hydrogen atom bonded to a carbon atom, a $C_1$-$C_{50}$ hydrocarbon group, a $C_1$-$C_{50}$ functional group selected from an amino group, an amide group, an ether group, a thioether group, a dithioether group and a carboxyl group, or a hydrocarbon group which has 1 to 150 carbon atoms in total and which has at least one group selected from these functional groups. $R^{13}$ and $R^{14}$ do not represent a hydrogen atom at the same time.

In the above general formula (III), (2) when p is 1, $X^1$, $X^2$, $X^3$ and $X^4$ each independently represent N, NH, O or S, x and y each independently represent an integer of 0 to 2, u and r each independently represent an integer of 0 to 3, t and w each independently represent an integer of 0 to 3, and v represents an integer of 0 to 3, n and m each independently represent an integer of 0 or 1, k is an integer of 0 to 3, and $R^{13}$ to $R^{16}$ each independently represent a hydrogen atom bonded to a carbon atom; a $C_1$-$C_{50}$ hydrocarbon group; a $C_1$-$C_{50}$ functional group selected from an amino group, an amide group, an ether group, a thioether group, a dithioether group and a carboxyl group; or a hydrocarbon group which has 1 to 150 carbon atoms in total and which has at least one group selected from these functional groups. $R^{13}$ to $R^{16}$ do not represent a hydrogen atom at the same time.

In the above general formula (III), $Y^1$ and $Y^2$ each independently represent a hydrogen atom; a halogen atom; a $C_1$-$C_{50}$ functional group selected from an amino group, an amide group, a hydroxyl group, a carbonyl group, an aldehyde group, a carboxyl group, an ester group and an ether group; or a hydrocarbon group or a heterocyclic group each of which has 1 to 150 carbon atoms in total and may have at least one group selected from these functional groups.

In the above general formula (III), $R^{13}$ to $R^{16}$ are each preferably a hydrogen atom, a $C_1$-$C_{150}$ hydrocarbon group, a thioether group or a dithioether group, more preferably a $C_1$-$C_{150}$ hydrocarbon group. Specific examples of such a hydrocarbon group include methyl, ethyl, propyl, butyl, hexyl, octyl, 2-ethylhexyl, decyl, dodecyl, dodecenyl, tetradecene, tetradecenyl, hexadecene, hexadecenyl, octadecyl, octadecenyl, oleyl, stearyl, isostearyl, dococenyl, a decene trimer and a polybutene group. These hydrocarbon groups may be linear or branched, and saturated or unsaturated. Still more preferred is a $C_8$-$C_{30}$ hydrocarbon group such as octyl, 2-ethylhexyl, decyl, dodecyl, dodecenyl, tetradecene, tetradecenyl, hexadecene, hexadecenyl, octadecyl, octadecenyl, oleyl, stearyl, isostearyl, dococenyl or a decene trimer The heterocyclic compound represented by the general formula (III) may be obtained, for example, by reacting (a) a compound having, as its basic skeleton (which skeleton provides a basic skeleton of the heterocyclic ring), pyridine, pyrrole, pyrimidine, pyrazole, pyridazine, imidazole, pyrazine, triazine, triazole, tetrazole, oxazole, oxadiazole, thiazole, thiadiazole, furan, dioxane, pyrane or thiophene, or a derivative thereof with (b) a halogen compound having an alkyl, alkenyl or cycloalkyl group having 10 to 200 carbon atoms, an amine compound, an alcohol compound, a mercapto compound, an epoxy compound or a compound having a functional carboxyl group such as a carboxyl group, in a molar ratio (a):(b) of 1:5 to 5:1, preferably 1:2 to 2:1.

When the molar ratio (a):(b) is 1:5 or more to 5:1 or less, it is possible to prevent an excessive reduction of an amount of the effective component for the wear resisting agent. Further, it is not necessary to use the agent in a large amount in order to achieve wear resistance, wear reduction and base number maintenance.

The reaction of (a) with (b) is carried out at room temperature to 200° C., preferably at 50 to 150° C. The reaction may be performed in the presence or absence of a catalyst. A solvent such as an organic solvent, e.g. hexane, toluene, xylene, tetrahydrofuran (THF) or dimethylformamide (DMF), may be used for carrying out the reaction.

Additionally, for example, a triazol compound may be obtained by reaction of the corresponding amine compound with a diacylhydrazine or by reaction of the corresponding aminoguanidine derivative with an acid derivative. A thiadiazole compound may be obtained by reaction of the corresponding sulfur compound with a diacylhydrazine. A triazine compound may be obtained by trimerization of the corresponding nitrile compound so as to form a heterocyclic ring.

The heterocyclic ring of the heterocyclic compound represented by the general formula (III) has such a basic skeleton that one ring thereof is a saturated or unsaturated compound having a total number of nitrogen atom and/or oxygen atom and/or sulfur atom of 1 to 4.

Examples of such a cyclic compound include pyridine, pyrrole, pyrimidine, pyrazole, pyridazine, imidazole, pyrazine, triazine, triazole, tetrazole, oxazole, oxadiazole, thiazole, thiadiazole, furan, dioxane, pyrane, thiophene and derivatives thereof.

Above all, pyridine, pyrrole, pyrimidine, pyrazole, pyridazine, imidazole, pyrazine, triazine, triazole, tetrazole, oxazole, oxadiazole, thiadiazole, furan, dioxane, pyrane and derivatives thereof are more preferred.

These cyclic compounds may be monocyclic compounds described above or polycyclic compounds such as indole, indazole, benzotriazole, benzoimidazole, purine, quinoline, isoquinoline, naphthyridine, carbazole and naphthoimidazole.

Further, the heterocyclic compound may be one in which a hydrocarbon group, an amine, an amide, an alcohol, a ketone, an aldehyde, a carboxylic acid, an ester, an ether, a thioether, a dithioether, a halogen, or a hydrocarbon compound containing those is added as a functional group. Preferably, the heterocyclic compound is one in which a hydrocarbon group, an amine, an amide, an alcohol, a ketone, an aldehyde, a carboxylic acid, an ester, an ether, a thioether, a dithioether or a hydrocarbon compound containing those is added as a functional group.

Examples of the functional group added to the heterocyclic compound include alkyl groups such as a methyl group, an ethyl group, a propyl group, a butyl group, a pentyl group and a hexyl group; substituted or unsubstituted amino groups such as an amino group, a methylamino group, an ethylamino group, a dimethylamino group, a diethylamino group and an aminomethyl group; a carbamoyl group; a hydroxyl group, a hydroxymethyl group, a hydroxyethyl group; a carboxymethyl group, a carboxyethyl group; an ethoxyl group, a propoxyl group; a methoxycarbonyl group, an ethoxycarbonyl group; a methylcarbonyl group, an ethylcarbonyl group; an acetoxyl group, a propioxyl group, a butyloyloxyl group; a formyl group; halogens; sulfide or disulfide groups such as alkylthio groups and alkyldithio groups; polyethylenepolyamine residues such as diethylenetriamine, triethylenetetramine and tetraethylenepentamine; and an aminoethylpiperazine residue.

As the preferred functional group, there may be mentioned alkyl groups such as a methyl group, an ethyl group, a propyl group, a butyl group, a pentyl group and a hexyl group; substituted or unsubstituted amino groups such as an amino group, a methyl amino group, an ethylamino group, a dimethylamino group and a diethylamino group; and sulfide or disulfide groups such as alkylthio groups and alkyldithio groups.

Examples of compound (b) include bromine-based compounds such as 2-decyl-1-bromotetradecane, 2-butyl-1-bromooctane, 2-pentyl-1-bromononane, 2-hexyl-1-bromodecane, 2-heptyl-1-bromoundecane, 2-octyl-1-bromododecane, 2-nonyl-1-bromotridecane, 2,4-dioctyl-1-bromotetradecane, bromopolybutane, bromooctane, bromododecane, bromododecane, bromotetradecane, bromohexadecane, bromooctadecane, bromoeicosane, bromodocosane, bromotetracosane, bromoheptadecene and bromoisostearyl; chlorine-based compounds such as 2-decyl-1-chlorotetradecane, 2-butyl-1-chlorooctane, 2,4-dioctyl-1-chlorotetradecane, chloropolybutane, chlorooctane, chlorododecane, chlorotetracosane and chloroheptadecene; iodine-based compounds such as 2-decyl-1-iodotetradecane, 2-butyl-1-iodooctane, 2,4-dioctyl-1-iodotetradecane, iodopolybutene, iodooctane, iodododecane, iodotetracosane and iodoheptadecene; epoxy compounds such as 2-decyl-1,2-epoxytetradecane, 2-butyl-1,2-epoxyoctane, 2,4-dioctyl-1,2-epoxytetradecane, polybutene epoxide, 1,2-epoxyoctane, 1,2-epoxydodecane, 1,2-epoxytetracosane and 1,2-epoxyheptadecene; amine compounds such as 2-decyl-tetradecylamine, 2-butyl-octylamine, 2,4-dioctyl-1-tetradecylamine, polybutenylamine, octylamine, dodecylamine, tetracosylamine, heptadecenylamine, aniline and a substituted aniline; mercaptan compounds such as 2-decyl-tetradecyl mercaptan, 2-butyl-octyl mercaptan, 2,4-dioctyl-1-tetradecyl mercaptan, polybutenyl mercaptan, octyl mercaptan, dodecyl mercaptan and tetracosyl mercaptan and heptadecenyl mercaptan; alcohols such as 2-decyl-tetradecyl alcohol, 2-butyl-octyl alcohol, 2,4-dioctyl-1-tetradecyl alcohol, polybutenyl alcohol, octyl alcohol, dodecyl alcohol, tetracosyl alcohol, heptadecenyl alcohol, phenol and a substituted phenol; and compounds having a carboxyl group such as 2-decyl-tetradecanoic acid, 2-butyl-octanoic acid, 2,4-dioctyl-1-tetradecanoic acid, polybutenyl carboxylic acid, octanoic acid, dodecanoic acid, tetracosanoic acid and heptadecenoic acid. These compounds may be used alone or as a mixture of two or more thereof.

In the heterocyclic compound represented by the general formula (III), the cyclic structure part in the case where p represents 0 or the two-cyclic structure part in the case where p represents 1 are each derived from the compound (a), while at least one of $Y^1$ and $Y^2$ is derived from the compound (b).

A reaction product between the heterocyclic compound represented by the general formula (III) and a boron compound, which is a wear resisting agent of the present invention, is obtained by reacting the heterocyclic compound obtained as described above with a boron compound in a molar ratio of the heterocyclic compound to the boron compound of 1:0.01 to 1:10, preferably 1:0.05 to 1:5.

The reaction of the heterocyclic compound with the boron compound is carried out at 50 to 250° C., preferably at 100 to 200° C.

In performing the reaction, a solvent such as an organic solvent, e.g., a hydrocarbon oil, hexane, heptane, octane, toluene or xylene, may be used.

As the boron compound, there may be used, for example, boron oxide, boron halide, boric acid, boric anhydride or a boric acid ester.

A reaction product between the heterocyclic compound represented by the general formula (III) and a molybdenum compound, which is also a wear resisting agent of the present invention, is obtained by reacting the heterocyclic compound obtained as described above with a molybdenum compound in a molar ratio of the heterocyclic compound to the molybdenum compound of 1:0.01 to 1:10, preferably 1:0.05 to 1:5.

The reaction of the heterocyclic compound with the molybdenum compound is carried out at 50 to 250° C., preferably at 100 to 200° C.

In performing the reaction, a solvent such as an organic solvent, e.g., a hydrocarbon oil, hexane, heptane, octane, toluene or xylene, may be used. As the molybdenum compound, there may be used, for example, molybdenum oxide, molybdenum halide or molybdic acid.

A reaction product between the heterocyclic compound represented by the general formula (III) and a silicon compound, which is also a wear resisting agent of the present invention, is obtained by reacting the heterocyclic compound obtained as described above with a silicon compound in a molar ratio of the heterocyclic compound to the silicon compound of 1:0.01 to 1:10, preferably 1:0.05 to 1:5.

The reaction of the heterocyclic compound with the silicon compound is carried out at 50 to 250° C., preferably at 100 to 200° C. In performing the reaction, a solvent such as an organic solvent, e.g., a hydrocarbon oil, hexane, heptane, octane, toluene or xylene, may be used.

As the silicon compound, there may be used, for example, silicon oxide, silicon halide or silicic acid or a silicic acid ester.

In the present invention, the above-described components (A) to (C) may be used singly or as a mixture of two or more thereof.

The compounding amounts of the components (A) and (B) are each preferably 0.01 to 5.0% by mass, more preferably 0.1 to 2.0% by mass, based on a total amount of the composition. When the amount is 0.01% by mass or more, sufficient degrees of deposition resistance and wear resistance may be achieved. When the amount exceeds 5.0% by mass, there may cause a case where the obtained effect does not correspond to the compounding amount.

The compounding amount of the component (C) is 0.01 to 20% by mass, preferably 0.05 to 15% by mass, more preferably 0.1 to 10% by mass based on a total amount of the composition. When the amount is 0.01% by mass or more, deposition resistance and wear resistance may be achieved. When the amount does not exceed 20% by mass, an increase of costs may be attained while preventing a reduction of the inherent properties of the lubricant base oil.

In the lubricant oil composition of the present invention, a customarily employed additive may be compounded as long as the effect thereof is not adversely affected. Examples of the additive include an antioxidant, a metallic detergent, a viscosity index improver, a pour point depressant, a metal deactivator, a rust inhibitor and a defoaming agent.

The above-mentioned antioxidant is preferably a phosphorus-free antioxidant. Examples of the phosphorus-free antioxidant include a phenol-based antioxidant, an amine-based antioxidant, a molybdenum/amine complex-based antioxidant and a sulfur-based antioxidant.

Specific examples of the phenol-based antioxidant include 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-cresol, 2,6-di-t-butyl-4-(N,N'-dimethylaminomethylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl)sulfide, bis(3,5-di-t-butyl-4-hydroxybenzyl) sulfide, n-octyl-3-(4-hydroxy-3,5-di-t-butylphenyl)

propionate, n-octadecyl-3-(4-hydroxy-3,5-di-t-butylphenyl) propionate, and 2,2'-thio[diethyl-bis-3-(3,5-di-t-butyl-4-hydroxyphenyl)-propionate].

Above all, especially preferred are bisphenol-based antioxidants and ester group-containing phenol-based antioxidants.

Specific examples of the amine-based antioxidant include monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; α-naphthylamine; phenyl-α-naphthylamine; and alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine.

Above all, the dialkyldiphenylamine-based and naphthylamines-based antioxidants are preferred.

As the molybdenum/amine complex-based antioxidants, there may be mentioned, for example, hexavalent molybdenum compounds. Specific examples of such compounds include those which are obtained by reacting molybdenum trioxide and/or molybdic acid with an amine compound and those which are obtained by the production method described in JP-A-2003-252887.

The amine compound to be reacted with the hexavalent molybdenum compound is not particularly limited, and there may be mentioned monoamines, diamines, polyamines and alkanol amines. Specific examples of the amine compound include alkyl amines having an $C_1$ to $C_{30}$ alkyl group or groups (the alkyl group may be either linear or branched) such as methylamine, ethylamine, dimethylamine, diethylamine, methylethylamine and methylpropylamine; alkenyl amines containing a $C_2$ to $C_{30}$ alkenyl group or groups (the alkenyl group may be linear or branched) such as ethenyl amine, propenyl amine, butenyl amine, octenyl amine and oleyl amine; alkanol amines containing a $C_1$ to $C_{30}$ alkanol group or groups (the alkanol group may be linear or branched) such as methanol amine, ethanol amine, methanol ethanol amine and methanol propanol amine; alkylene diamines containing a $C_1$ to $C_{30}$ alkylene group or groups such as methylenediamine, ethylenediamine, propylenediamine and butylenediamine; polyamines such as diethylenetriamine, triethylenetetramine, tetraethylenepentamine and pentaethylenehexamine; compounds, such as undecyldiethylamine, undecyldiethanol amine, dodecyldipropanol amine, oleyldiethanol amine, oleylpropylenediamine and stearyltertraethylenepentamine, which are obtained by further introducing a $C_8$ to $C_{20}$ alkyl or alkenyl group into the above monoamines, diamines or polyamines; heterocyclic compounds such as imidazoline; alkyleneoxide adducts of these compounds; and mixtures of these compounds.

In addition, as the molybdenum complex-based antioxidants, there may be mentioned, for example, sulfur-containing molybdenum complexes of succinic imide as described in JP-H3-22438B and JP-2004-2866A. More concretely, such a complex may be produced by the following steps (m) and (n):

(m) reacting an acidic molybdenum compound or salt thereof with a basic nitrogen compound selected from the group consisting of succinimides, carboxylic acid amides, hydrocarbyl monoamines, hydrocarbyl polyamines, Mannich bases, phosphonoamides, thiophosphonamides, phosphoramides, dispersant viscosity index improvers and mixtures thereof, at a reaction temperature of below about 120° C. to form a molybdenum complex; and (n) subjecting the product of step (m) to at least one stripping or sulfurization step or to both of these steps, wherein the temperature of the reaction mixture in the stripping or sulfurization step is maintained at about 120° C. or less for a period of time sufficient to provide a molybdenum complex that shows an absorbance of less than 0.7 at a wavelength of 350 nanometers when measured in a one centimeter path-length quartz cell using a UV-visible spectrophotometer in such a state that the molybdenum complex is diluted with isooctane to provide a constant molybdenum concentration of 0.00025 gram of molybdenum per gram of the diluted molybdenum complex.

The molybdenum complex may also be prepared by the following steps (o), (p) and (q):

(o) reacting an acidic molybdenum compound or salt thereof with a basic nitrogen compound selected from the group consisting of succinimides, carboxylic acid amides, hydrocarbyl monoamines, hydrocarbyl polyamines, Mannich bases, phosphonoamides, thiophosphonamides, phosphoramides, dispersant viscosity index improvers and mixtures thereof, at a reaction temperature of below about 120° C. to form a molybdenum complex;

(p) stripping the product of step (o) at a temperature of about 120° C. or less; and (q) sulfurizing the resulting product at a temperature at or below 120° C. or less in a sulfur to molybdenum molar ratio of about 1:1 or less for a period of time sufficient to provide a molybdenum complex that shows an absorbance of less than 0.7 at a wavelength of 350 nanometers when measured in a one centimeter path-length quartz cell using a UV-visible spectrophotometer in such a state that the molybdenum complex is diluted with isooctane to provide a constant molybdenum concentration of 0.00025 gram of molybdenum per gram of the diluted molybdenum complex.

As the sulfur-based antioxidant, there may be mentioned, for example, phenothiazine, pentaerythritol-tetrakis-(3-lauryl thiopropionate), didodecyl sulfide, dioctadecyl sulfide, didodecyl thiodipropionate, dioctadecyl thiodipropionate, dimyristyl thiodipropionate, dodecyloctadecyl thiodipropionate and 2-mercaptobenzoimidazole.

Among these antioxidants, from the standpoint of reducing a metal content and a sulfur content, phenol-based antioxidants and amine-based antioxidants are preferred. The above antioxidants may be used singly or as a mixture of two or more thereof. From the standpoint of improved oxidation stability, a mixture of one or more kinds of phenol-based antioxidants and one or more kinds of amine-based oxidants is preferably used.

The compounding amount of the antioxidant is generally 0.1% to 5% by mass, more preferably from 0.1% to 3% by mass, based on the total mass of the composition. The compounding amount of the molybdenum complex is 10 to 1,000 ppm by mass, more preferably 30 to 800 ppm by mass, still preferably 50 to 500 ppm by mass, in terms of molybdenum element based on the total mass of the composition.

As the above-mentioned metallic detergent, there may be used any alkaline earth metal-based detergents which are employed for ordinary lubricant oils. Examples of the alkaline earth metal-based detergent include alkaline earth metal sulfonates, alkaline earth metal phenates, alkaline earth metal salicylates and mixtures of two or more thereof.

As the alkaline earth metal sulfonates, there may be mentioned alkaline earth metal salts of an alkyl aromatic sulfonic acid obtained by sulfonating an alkyl aromatic compound having a molecular weight of 300 to 1,500, preferably 400 to 700. Among them, magnesium salts and/or calcium salts, especially calcium salts are preferred.

As the alkaline earth metal phenates, there may be mentioned alkaline earth metal salts of alkylphenols, alkylphenol sulfides and Mannich reaction products of alkylphenols. Among them, magnesium salts and/or calcium salts, especially calcium salts are preferred.

As the alkaline earth metal salicylates, there may be mentioned alkaline earth metal salts of alkyl salicylic acids. Among them magnesium salts and/or calcium salts, especially calcium salts are preferred.

The alkyl group contained in the compounds constituting the above alkaline earth metal-based detergents is preferably a $C_4$ to $C_{30}$ alkyl group, more preferably a $C_6$ to $C_{16}$ linear or branched alkyl group.

These alkyl groups may be straight chained or branched.

These alkyl groups may be primary alkyl groups, secondary alkyl groups or tertiary alkyl groups.

As the alkaline earth metal sulfonates, alkaline earth metal phenates and alkaline earth metal salicylates, there may be used neutral alkaline earth metal sulfonates, neutral alkaline earth metal phenates and neutral alkaline earth metal salicylates which may be produced by directly reacting the above alkyl aromatic sulfonic acids, alkylphenols, alkylphenol sulfides, Mannich reaction products of alkylphenols, alkyl salicylic acids or the like with an alkaline earth metal base such as an oxide or a hydroxide of an alkaline earth metal such as magnesium and/or calcium or which may be produced by once forming an alkali metal salt thereof and then converting the alkali metal salt into an alkaline earth metal salt. Further, there may also be used basic alkaline earth metal sulfonates, basic alkaline earth metal phenates and basic alkaline earth metal salicylates which may be produced by heating neutral alkaline earth metal sulfonates, neutral alkaline earth metal phenates and neutral alkaline earth metal salicylates together with an excess amount of an alkaline earth metal salt or an alkaline earth metal base in the presence of water. Furthermore, there may also be used perbasic alkaline earth metal sulfonates, perbasic alkaline earth metal phenates and perbasic alkaline earth metal salicylates which may be produced by reacting neutral alkaline earth metal sulfonates, neutral alkaline earth metal phenates and neutral alkaline earth metal salicylates with an alkaline earth metal carbonate or an alkaline earth metal borate in the presence of carbon dioxide.

The metallic detergent used in the present invention is preferably an alkaline earth metal salicylate or alkaline earth phenate, especially a perbasic salicylate or perbasic phenate, for reasons of reducing a sulfur content of the composition.

The total base number of the metallic detergent used in the present invention is preferably 10 to 500 mg KOH/g, more preferably 15 to 450 mg KOH/g. The metallic detergent may be selected from these detergents and used singly or in combination of two or more thereof.

The term "total base number" as used herein means the value as measured by a potentiometric titration method (base number/perchlorate method) according to the Item 7 of JIS K 2501 "Petroleum Products and Lubricants-Neutralization Number Testing Method."

The metal ratio of the metallic detergent used in the present invention is not specifically limited. The metallic detergent having a metal ratio of 20 or less may be generally used singly or as a mixture of two or more thereof. The metallic detergent having a metal ratio of preferably 3 or less, more preferably 1.5 or less, still more preferably 1.2 or less, is particularly suitably used for reasons of further improved oxidation stability, base number retention property, high-temperature detergency, etc.

Meanwhile, the term "metal ratio" as used herein means a ratio represented by the formula: valence of a metal element× content (mol %) of the metal element/content (mol %) of a soap group wherein the metal element is calcium, magnesium, etc., and the soap group is a sulfonic group, a phenol group, a salicylic group, etc.

The compounding amount of the metallic detergent is preferably 0.01% to 20% by mass, more preferably 0.1% to 10% by mass, still more preferably 0.5% to 5% by mass, based on the total amount of the lubricant oil composition.

A compounding amount of the metallic detergent less than 0.01% by mass is not preferable because performances such as high temperature detergency, oxidation stability and base number retention property are not easily obtainable. When the amount of the metallic detergent compounded is 20% by mass or less, an effect proportional to the compounding amount of the metallic detergent may be generally obtained. In spite of the above specified range, however, it is important that the upper limit of the compounding amount of the metallic detergent should be as low as possible. By so doing, the metal content, namely sulfuric acid ash content, of the lubricant oil composition is reduced, with the result that the exhaust gas purification device of automobiles is prevented from being deteriorated.

The metallic detergent may be used singly or in combination of two or more thereof as long as the content thereof lies within the above-specified range.

Specifically, among the above-mentioned metallic detergents, perbasic calcium salicylate and perbasic calcium phenate are particularly preferred. Among the above-mentioned ashless dispersants, the above-mentioned bis-polybutenylsuccinimide is particularly preferred. Meanwhile, it is preferred that perbasic calcium salicylate and perbasic calcium phenate each have a total base number of 100 to 500 mgKOH/g, more preferably 200 to 500 mgKOH/g.

As the above-mentioned viscosity index improver, there may be mentioned, for example, polymethacrylates, dispersion type polymethacrylates, olefin-based copolymers (such as ethylene-propylene copolymers), dispersion type olefin-based copolymers and styrene-based copolymers (such as styrene-diene copolymers and styrene-isoprene copolymers).

The compounding amount of the viscosity index improver is preferably 0.5% to 15% by mass, more preferably 1% to 10% by mass, based on the total amount of the lubricant oil composition from the standpoint of effects attained by addition thereof.

As the above-mentioned pour point depressant, there may be mentioned, for example, polymethacrylates having a weight-average molecular weight of about 5,000 to about 50,000.

The compounding amount of the pour point depressant is generally 0.1% to 2% by mass, more preferably 0.1% to 1% by mass, based on the total amount of the lubricant oil composition from the standpoint of effects attained by addition thereof.

As the metal deactivator, there may be mentioned, for example, benzotriazole-based compounds, tolyl triazole-based compounds, thiadiazole-based compounds and imidazole-based compounds.

The compounding amount of the metal deactivator is preferably 0.01% to 3% by mass, more preferably 0.01% to 1% by mass, based on the total amount of the lubricant oil composition.

As the rust inhibitor, there may be mentioned, for example, petroleum sulfonates, alkylbenzene sulfonates, dinonylnaphthalene sulfonates, alkenylsuccinic acid esters and polyhydric alcohol esters.

The compounding amount of the rust inhibitor is preferably 0.01% to 1% by mass, more preferably 0.05% to 0.5% by mass, based on the total amount of the lubricant oil composition from the standpoint of effects attained by addition thereof.

As the above-mentioned defoaming agent, there may be mentioned, for example, silicone oils, fluorosilicone oils and fluoroalkyl ethers. The compounding amount of the defoaming agent is preferably 0.005% to 0.5% by mass, more preferably 0.01% to 0.2% by mass, based on the total amount of the lubricant oil composition from the standpoint of a balance between the defoaming effect and economy.

The lubricant oil composition of the present invention may further contain a friction modifier, an anti-wear agent and an extreme pressure agent, if necessary. The friction modifier herein is a compound other than the polar group-containing compounds which are an essential ingredient of the present invention. The compounding amount of the friction modifier agent is preferably 0.01% to 2% by mass, more preferably 0.01% to 1% by mass or less, based on the total amount of the lubricant oil composition.

As the anti-wear agent or the extreme-pressure agent, there may be mentioned sulfur containing compounds such as zinc dithiophosphate, zinc phosphate, zinc dithiocarbamate, molybdenum dithiocarbamate, molybdenum dithiophosphate, disulfides (other than the sulfur-containing compounds of the general formula (I) or (II) used in the present invention; dibenzyldisulfide is an example thereof), sulfurized olefins, sulfurized oils and fats, sulfurized esters, thiocarbonates, thiocarbamates and polysulfides; phosphorus containing compounds such as phosphorous acid esters, phosphoric acid esters, phosphonic acid esters and amine salts or metal salts of these esters; and sulfur- and phosphorus-containing anti-wear agents such as thiophosphorous acid esters, thiophosphoric acid esters, thiophosphonic acid esters and amine salts or metal salts of these esters.

The compounding amount of the anti-wear agent or the extreme-pressure agent to be compounded should be such that the phosphorus content and metal content of the lubricant oil are not excessively large by addition thereof.

The lubricant oil composition of the present invention may be formulated as described in the foregoing and preferably has the following properties:

(1) the sulfuric acid ash content (JIS K 2272) is 0.6% by mass or less, more preferably 0.1% by mass or less; and (2) the phosphorus content (JPI-5S-38-92) is 0.05% by mass or less, more preferably 0.02% by mass or less, still more preferably 0% by mass.

Additionally, it is more preferred that the following properties are met:

(3) the sulfur content (JIS K 2541) is 0.4% by mass or less, more preferably 0.2% by mass or less; and (4) the boron content is 0.4% by mass or less, more preferably 0.2% by mass or less.

The lubricant oil composition of the present which satisfies the above properties can suppress deterioration of an oxidation catalyst, a three way catalyst, an $NO_x$ occlusion reduction catalyst, a diesel particulate filter (DPF), etc. which are used in automobile engines.

The lubricant oil composition of the present invention uses a combination of a polybutenylsuccinimide with components (A) to (C). As a result of such a combined use, there is achieved deposition resistance which cannot be achieved by use of each component by itself. Accordingly, even when zinc dithiophosphate which has been hitherto often used as a lubricant oil additive is not used, the lubricant oil composition shows sufficiently excellent lubricating performance and makes it possible to achieve properties of low sulfuric acid ash, etc.

It is preferred that the lubricant oil composition of the present invention show a rating of 2 or less when subjected to a copper plate corrosion test (measurement conditions: 100° C., 3 hours) as specified in JIS K 2513. When a rating of 2 or less is attained in the copper plate corrosion test, a hydraulic fluid composition has good heat resistance and shows an effect of suppressing the formation of sludge. A rating of 1 in the copper plate corrosion test is more preferred.

The lubricant oil composition of the present invention can be suitably used as a lubricant oil for use in an internal combustion engine, such as a gasoline engine, a diesel engine or a gas engine, for two-wheeled vehicles, four-wheeled vehicles, power generators, ships or the like, and is particularly suited for internal combustion engines equipped with an exhaust gas purification device because of its low phosphorus content, low sulfur content and low sulfuric acid ash content.

The lubricant oil composition of the present invention is also suitably used for applications other than those described above. Especially, since the lubricant oil composition of the present invention shows excellent wear resistance and friction reducing effect, it can be used for lubrication of internal combustion engines, automatic transmissions, continuously variable transmissions, manual transmissions, power steerings, shock absorbers, compressors, cooling medium compressors, refrigerators, hydraulic pumps and clutch pulleys. Namely, the lubricant oil composition of the present invention may be used as internal combustion engine oils, automatic transmission oils, continuously variable transmission oils, manual transmission oils, power steering oils, shock absorber oils, compressor oils, refrigerator oils, hydraulic pump oils and clutch pulley lubricating oils and greases.

EXAMPLES

The present invention will be next described in more detail by way of Examples and Comparative Examples. The scope of the present invention, however, is not limited to these examples in any way.

Methods for Measuring Properties and Performances:

The properties and performances of the lubricant oil compositions obtained in the following Examples and Comparative Examples are measured by the methods shown below.

(1) Phosphorus Content:

Measured according to JPI-5S-38-92.

(2) Sulfur Content:

Measured according to JIS K 2541.

(3) Boron Content:

Measured according to JPI-5S-38-92.

(4) Sulfuric Acid Ash Content:

Measured according to JIS K 2272.

(5) Hot Tube Test:

Measurement was performed under the conditions according to JPI-5S-55-99 except that the test temperature was set to 300° C. After the test, the test tube was evaluated according to JPI-5S-55-99, i.e. according to 11 ratings from 0 point (black) to 10 point (colorless). The higher the rating point, the better is the deposition resistance.

(6) Copper Plate Corrosion Test:

Except for the use of a test temperature of 100° C. and a test time of 3 hours, the test was performed according to JIS K-2513. The evaluation was made according to the four ratings shown below. The smaller the score, the better is the corrosion resistance.

1: slightly colored
2: fairly colored
3: highly colored
4: corroded (7) Reciprocating Friction Test Using a SUJ-2 plate, as a test plate, having a hardness (HRC) of 61, a ten-point average surface roughness (Rz) of 0.042 μm and a size of 3.9 mm×38 mm×58 mm and an SUJ-2 ball, as a test ball, having a diameter of 10 mm, an abrasion test was carried out with a reciprocating friction tester under the conditions shown below. After completion of the abrasion test, the wear track size of the test ball was measured. The smaller the wear track size of the test ball after completion of the abrasion test, the better is the wear resistance.

Testing Conditions
Testing Temperature: 100° C.
Load: 200 N
Amplitude: 10 mm
Frequency: 10 Hz
Testing Time: 30 min Examples 1 to 13 and Comparative Examples 1 to 11

The base oil and additives shown in Table 1 and Table 2 were blended in the proportion shown in Table 1 and Table 2 to prepare lubricant oil compositions. The properties, formulations and performances of the compositions are also shown in Table 1 and Table 2.

TABLE 1

| | | Examples | | | | | | | |
|---|---|---|---|---|---|---|---|---|---|
| | | 1 | 2 | 3 | 4 | 5 | 6 | 7 | 8 |
| Formulation Composition (% by mass) | Base oil | 95.34 | 96.00 | 95.08 | 95.70 | 96.00 | 96.00 | 93.50 | 94.42 |
| | Polybutenylsuccinimide | 4.00 | 4.00 | 4.00 | 4.00 | 4.00 | 4.00 | 4.00 | 4.00 |
| | Compound A | 0.66 | | | | | | 0.66 | 0.66 |
| | Compound B | | 1.84 | | | | | 1.84 | |
| | Compound C | | | 0.92 | | | | | 0.92 |
| | Compound D | | | | 0.3 | | | | |
| | Compound E | | | | | 1.0 | | | |
| | Compound F | | | | | | 1.0 | | |
| | Total | 100.00 | 100.00 | 100.00 | 100.00 | 100.00 | 100.00 | 100.00 | 100.00 |
| Properties | Boron content (% by mass) | 0.08 | 0.08 | 0.08 | 0.08 | 0.08 | 0.08 | 0.08 | 0.08 |
| | Phosphorus content (% by mass) | 0.00 | 0.00 | 0.00 | 0.00 | 0.00 | 0.00 | 0.00 | 0.00 |
| | Zinc content (% by mass) | 0.00 | 0.00 | 0.00 | 0.00 | 0.00 | 0.00 | 0.00 | 0.00 |
| | Sulfur content (% by mass) | 0.1 | 0.1 | 0.1 | 0.1 | 0 | 0 | 0.2 | 0.2 |
| | Sulfuric acid ash content (% by mass) | 0.05 | 0.05 | 0.05 | 0.05 | 0.05 | 0.05 | 0.05 | 0.05 |
| Hot tube test (rating) | | 7.5 | 9.5 | 9.5 | 8.0 | 9.5 | 9.5 | 9.5 | 9.5 |
| Copper plate corrosion test (rating) | | 1 | 1 | 1 | 1 | 1 | 1 | 1 | 1 |
| Reciprocating friction test (wear track diameter; mm) | | 0.53 | 0.53 | 0.52 | 0.48 | 0.40 | 0.39 | 0.51 | 0.50 |

| | | Examples | | | | |
|---|---|---|---|---|---|---|
| | | 9 | 10 | 11 | 12 | 13 |
| Formulation Composition (% by mass) | Base oil | 95.04 | 93.86 | 94.78 | 95.34 | 95.34 |
| | Polybutenylsuccinimide | 4.00 | 4.00 | 4.00 | 4.00 | 4.00 |
| | Compound A | 0.66 | | | 0.66 | 0.66 |
| | Compound B | | 1.84 | | | |
| | Compound C | | | 0.92 | | |
| | Compound D | 0.3 | 0.3 | 0.3 | | |
| | Compound E | | | | 1.0 | |
| | Compound F | | | | | 1.0 |
| | Total | 100.00 | 100.00 | 100.00 | 100.00 | 100.00 |
| Properties | Boron content (% by mass) | 0.08 | 0.08 | 0.08 | 0.08 | 0.08 |
| | Phosphorus content (% by mass) | 0.00 | 0.00 | 0.00 | 0.00 | 0.00 |
| | Zinc content (% by mass) | 0.00 | 0.00 | 0.00 | 0.00 | 0.00 |
| | Sulfur content (% by mass) | 0.2 | 0.2 | 0.2 | 0.1 | 0.1 |
| | Sulfuric acid ash content (% by mass) | 0.05 | 0.05 | 0.05 | 0.05 | 0.05 |
| Hot tube test (rating) | | 9.5 | 9.5 | 9.5 | 9.5 | 9.5 |
| Copper plate corrosion test (rating) | | 1 | 1 | 1 | 1 | 1 |
| Reciprocating friction test (wear track diameter; mm) | | 0.50 | 0.47 | 0.47 | 0.49 | 0.45 |

TABLE 2

| | | Examples | | | | | | |
|---|---|---|---|---|---|---|---|---|
| | | 1 | 2 | 3 | 4 | 5 | 6 | 7 |
| Formulation Composition (% by mass) | Base oil | 95.77 | 95.74 | 95.04 | 96.00 | 96.00 | 99.34 | 98.16 |
| | Polybutenylsuccinimide | 4.00 | 4.00 | 4.00 | 4.00 | 4.00 | | |
| | Compound A | | | | | | 0.66 | |
| | Compound B | | | | | | | 1.84 |
| | Compound C | | | | | | | |
| | Compound D | | | | | | | |
| | Compound G | 0.23 | | | | | | |

TABLE 2-continued

| | | | | | | | | |
|---|---|---|---|---|---|---|---|---|
| | Compound H | | 0.26 | | | | | |
| | Compound I | | | 0.96 | | | | |
| | Compound J | | | | 0.33 | | | |
| | Zinc dialkyldithiophosphate | | | | | | | |
| | Total | 100.00 | 100.00 | 100.00 | 100.00 | 100.00 | 100.00 | 100.00 |
| Properties | Boron content (% by mass) | 0.08 | 0.08 | 0.08 | 0.08 | 0.08 | 0 | 0 |
| | Phosphorus content (% by mass) | 0.00 | 0.00 | 0.00 | 0.00 | 0.00 | 0.00 | 0.00 |
| | Zinc content (% by mass) | 0.00 | 0.00 | 0.00 | 0.00 | 0.00 | 0.00 | 0.00 |
| | Sulfur content (% by mass) | 0.1 | 0.1 | 0.1 | 0.1 | 0 | 0.1 | 0.1 |
| | Sulfuric acid ash content (% by mass) | 0.05 | 0.05 | 0.05 | 0.05 | 0.05 | 0 | 0 |
| Hot tube test (rating) | | 4.0 | 4.0 | 9.5 | 3.0 | 0 | 0 | 0 |
| Copper plate corrosion test (rating) | | 1 | 4 | 4 | 1 | 1 | 1 | 1 |
| Reciprocating friction test (wear track diameter; mm) | | 0.84 | 0.82 | 0.78 | 0.69 | 0.48 | 0.78 | 0.52 |

| | | Examples | | | |
|---|---|---|---|---|---|
| | | 8 | 9 | 10 | 11 |
| Formulation Composition (% by mass) | Base oil | 99.08 | 99.70 | 95.42 | 99.42 |
| | Polybutenylsuccinimide | | | 4.00 | |
| | Compound A | | | | |
| | Compound B | | | | |
| | Compound C | 0.92 | | | |
| | Compound D | | 0.3 | | |
| | Compound G | | | | |
| | Compound H | | | | |
| | Compound I | | | | |
| | Compound J | | | | |
| | Zinc dialkyldithiophosphate | | | 0.58 | 0.58 |
| | Total | 100.00 | 100.00 | 100.00 | 100.00 |
| Properties | Boron content (% by mass) | 0 | 0 | 0.08 | 0 |
| | Phosphorus content (% by mass) | 0.00 | 0.00 | 0.05 | 0.05 |
| | Zinc content (% by mass) | 0.00 | 0.00 | 0.05 | 0.05 |
| | Sulfur content (% by mass) | 0.1 | 0.1 | 0.1 | 0.1 |
| | Sulfuric acid ash content (% by mass) | 0 | 0 | 0.16 | 0.11 |
| Hot tube test (rating) | | 0 | 0 | 8.0 | 3.0 |
| Copper plate corrosion test (rating) | | 1 | 1 | 1 | 1 |
| Reciprocating friction test (wear track diameter; mm) | | 0.53 | 0.58 | 0.39 | 0.44 |

Note:

Base oil: Hydrogenated refined base oil (kinematic viscosity at 40° C.: 21 $mm^2/s$; kinematic viscosity at 100° C.: 4.5 $mm^2/s$; viscosity index: 127; % $C_A$: 0.0; sulfur content: less than 20 ppm by mass; NOACK test evaporation amount: 13.3% by mass)

Polybutenylsuccinic acid monoimide: (average molecular weight of polybutenyl group: 1,000; nitrogen content: 1.76% by mass; boron content: 1.9% by mass)

Zinc Dialkyldithiophosphate: (Zn content: 9.0% by mass; phosphorus content: 8.2% by mass; sulfur content: 17.1% by mass, alkyl groups: mixture of secondary butyl group and secondary hexyl group)

Compound A: Bis(n-octoxycarbonylmethyl) disulfide (sulfur content: 15.2%)

Compound B: Bis(tridecyloxycarbonylethyl) sulfide (sulfur content: 5.4%)

Compound C: 2,6-di-t-butyl-4-(4,6-bis(octylthio)-1,3,5-triazine-2-ylamino)phenol (sulfur content: 10.9%)

Compound D: 2,5-(bis(n-octyldithio)-1,3,4-thiadiazole (sulfur content: 33.5%)

Compound E: 5-(8-heptadecenyl)-3-amino-1,2,4-triazole

Compound F: Reaction product of 5-(8-heptadecenyl)-3-amino-1,2,4-triazole with boric acid Compound G: Olefin sulfide (sulfur content: 43%; product name: Anglamol 33; produced by Japan Lubrizol Inc.)

Compound H: Dioctylpolysulfide (sulfur content: 39%; product name: DAILUBE GS-440; produced by DIC Corporation)

Compound I: Sulfurized fat (sulfur content: 10.4%)

Compound J: Methylene bis(dibutyldithiocarbamate) (sulfur content: 30.3%)

As shown in Tables 1 and 2, the lubricant oil compositions of Examples 1 to 13 show high deposition resistance as well as good corrosion resistance and small wear track size because of the synergetic effect attained by the combined use of polybutenylsuccinic acid monoimide with a sulfur-containing compound, a heterocyclic compound or a reaction product thereof.

Further, as will be understood from the comparison of Examples 1 to 13 with Comparative Examples 5 to 9, the effect of the present invention that is achieved by the above-described combined use is not achievable when the polybutenylsuccinic acid monoimide, sulfur-containing compound, heterocyclic compound and reaction product thereof are used singly.

As described above, by using polybutenylsuccinimide in combination with a compound selected from specific sulfur-containing compounds, specific heterocyclic compounds and reaction products thereof, lubricant oil compositions that are excellent in deposition resistance, corrosion resistance and wear resistance, despite their low phosphorus content, low sulfur content and low sulfuric acid ash content, can be obtained.

INDUSTRIAL APPLICABILITY

According to the present invention there is provided a lubricant oil composition which is excellent in deposition resistance, corrosion resistance and wear resistance, despite its low phosphorus content, low sulfur content and low sulfuric acid ash content. The lubricant oil composition according to the present invention, therefore, can be particularly suitably used as a lubricant oil composition for internal combustion engines such as gasoline engines, diesel engines and gas engines.

The invention claimed is:

1. A lubricant oil composition, comprising:

mineral oil;

3 to 7% by mass, based on the total mass of the lubricant oil composition, of a boron derivative of polybutenylsuccinic acid monoamide; and at least one selected from the group consisting of component (A) and component (D), wherein component (A) is 0.1 to 2.0% by mass, based on the total mass of the lubricant oil composition, of a sulfur-comprising compound of formula (I):

$$R^1—Y—(CH_2)_n—S_{x1}—(CH_2)_n—Y—R^2 \quad (I),$$

wherein:

$R^1$ and $R^2$ are each independently i) a hydrogen atom; ii) a $C_1$-$C_{50}$ hydrocarbon group selected from an alkyl group, a cycloalkyl group, an alkenyl group, a cycloalkenyl group, and an aryl group, or iii) a $C_1$-$C_{50}$ hetero atom-comprising group comprising an atom selected from an oxygen atom, a nitrogen atom, and a sulfur atom, which is contained in a hydrocarbon group selected from the group consisting of an alkyl group, a cycloalkyl group, an alkenyl group, a cycloalkenyl group, and an aryl group;

each Y is independently a divalent group selected from —O—, —S—, —SO—, —$SO_2$—, —(C═O)O—, —(C═O)NH—, —O(C═O)NH—, —C(═O)—, —N(H)—, —NHCONH—, —N═N—, —NH—C(═NH)—NH— and —S—C(═O)—;

X1 is an integer of 1 to 3; and each n is independently an integer of 1 to 5; and wherein component (D) is 0.1 to 10% by mass, based on the total mass of the lubricant oil composition, of 2,5-(bis(n-octyldithio)-1,3,4-thiadiazole.

2. The lubricant oil composition of claim 1, having a phosphorus content of 0.5% by mass or less and a sulfuric acid ash content of 0.6% by mass or less, based on a total mass of the composition.

3. The lubricant oil composition of claim 1, having a phosphorus content of 0% by mass and a sulfuric acid ash content of 0.1% by mass or less, based on a total mass of the composition.

4. The lubricant oil composition of claim 1, comprising component (A), wherein, in formula (I), X1 is 1.

5. The lubricant oil composition of claim 1, wherein the lubricant oil composition is employed in an engine comprising a post treatment device.

6. The lubricant oil composition of claim 1, comprising component (A), wherein, in formula (I):

X1 is 1; and n is 1 ort.

7. The lubricant oil composition of claim 1, having a sulfur content of 0.4% by mass or less and a boron content of 0.4% by mass or less, based on a total mass of the composition.

8. The lubricant oil composition of claim 1, comprising component (A).

9. The lubricant oil composition of claim 1, comprising component (D).

10. The lubricant oil composition of claim 1, further comprising component (B), wherein component (B) is a sulfur-comprising compound of formula (II):

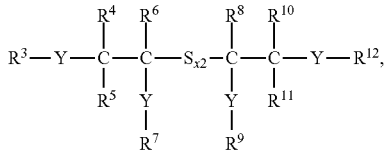

(II)

wherein:

$R^3$ to $R^{12}$ are each independently i) a hydrogen atom; ii) a $C_1$-$C_{50}$ hydrocarbon group selected from the group consisting of an alkyl group, a cycloalkyl group, an alkenyl group, a cycloalkenyl group, and an aryl group, or iii) a $C_1$-$C_{50}$ hetero atom-comprising group comprising an atom selected from the group consisting of an oxygen atom, a nitrogen atom, and a sulfur atom, which is contained in a hydrocarbon group selected from the group consisting of an alkyl group, a cycloalkyl group, an alkenyl group, a cycloalkenyl group, and an aryl group;

each Y is independently a divalent group selected from the group consisting of —O—, —S—, —SO—, —$SO_2$—, —(C═O)O—, —(C═O)NH—, —O(C═O)NH—, —C(═O)—, —N(H)—, —NHCONH—, —N═N—, —NH—C(═NH)—NH—, —S—C(═O)—, —NH—C(═S)— and —NH—C(═S)—NH—; and X2 is an integer of 1 to 3.

11. The lubricant oil composition of claim 8, wherein the component (A) is bis(tridecyloxycarbonylethyl) sulfide.

12. A lubricant oil composition, comprising:

mineral oil;

3 to 7% by mass, based on the total mass of the lubricant oil composition, of a boron derivative of polybutenylsuccinic acid monoamide; and at least one of 0.1 to 10% by mass, based on the total mass of the lubricant oil composition, of 2,6-di-t-butyl-4-(4,6-bis(octylthio)-1,3,5-triazine-2-ylamino)phenol and 2,5-(bis(n-octyldithio)-1,3,4-thiadiazole.

13. The lubricant oil composition of claim 8, wherein in formula (I):

$R^1$ and $R^2$ are each independently i) a hydrogen atom or ii) a $C_1$-$C_{50}$ alkyl group;

each Y is independently a divalent group selected from —O—, —(C═O)O— and —C(═O)—;

X1 is an integer of 1 or 2; and each n is independently an integer of 1 to 5.

14. A lubricant oil composition, comprising:

mineral oil;

3 to 7% by mass, based on the total mass of the lubricant oil composition, of a boron derivative of polybutenylsuccinic acid monoamide; and at least one of:

0.1 to 2.0% by mass, based on the total mass of the lubricant oil composition, of bis(tridecyloxycarbonylethyl) sulfide; and 0.1 to 10% by mass, based on the total mass of the lubricant oil composition, of 2,5-(bis(n-octyldithio)-1,3,4-thiadiazole.

* * * * *